United States Patent [19]

Burns

[11] 4,265,504

[45] May 5, 1981

[54] CONTACT RETENTION ASSEMBLY

[75] Inventor: Edgar Burns, Los Angeles, Calif.

[73] Assignee: International Telephone and Telegraph Corporation, New York, N.Y.

[21] Appl. No.: 71,875

[22] Filed: Sep. 4, 1979

[51] Int. Cl.[3] ..... H01R 13/432

[52] U.S. Cl. ..... 339/97 R; 339/217 S

[58] Field of Search ..... 339/217 S, 98, 99, 96, 339/97 R

[56] References Cited

U.S. PATENT DOCUMENTS

| | | | |
|---|---|---|---|
| 3,963,319 | 6/1976 | Schumacher et al. | 339/99 R |
| 4,006,961 | 2/1977 | Langenbach | 339/217 S |
| 4,046,450 | 9/1977 | Yurtin | 339/217 S |

FOREIGN PATENT DOCUMENTS

| | | | |
|---|---|---|---|
| 2255783 | 5/1974 | Fed. Rep. of Germany | 339/217 S |
| 2653593 | 6/1977 | Fed. Rep. of Germany | 339/99 R |

*Primary Examiner*—John McQuade

*Attorney, Agent, or Firm*—Thomas L. Peterson

[57] ABSTRACT

A contact retention assembly is disclosed for an electrical connector in which the contact has a retention section of U-shaped cross-section. One of the sidewalls of the U-shaped retention section has a retention tine formed therefrom which extends rearwardly and inwardly toward the opposite sidewall for engaging a forwardly facing shoulder provided by projection formed in the corner of the contact cavity.

18 Claims, 5 Drawing Figures

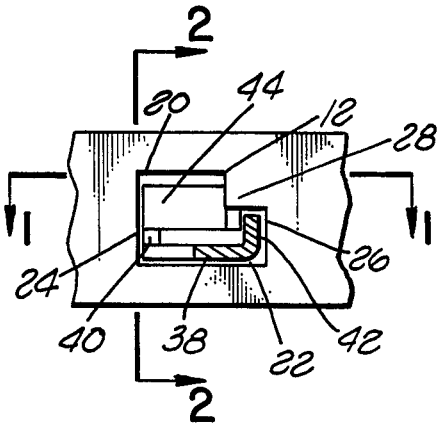
FIG. 3
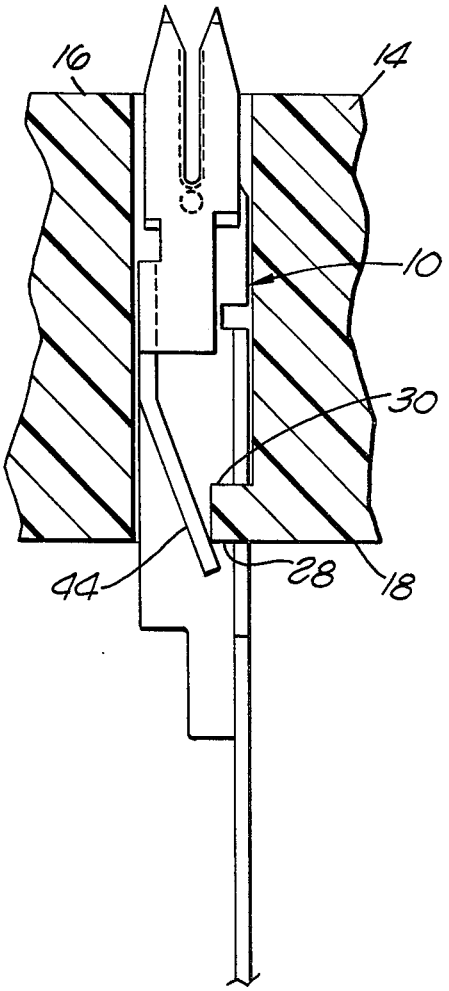
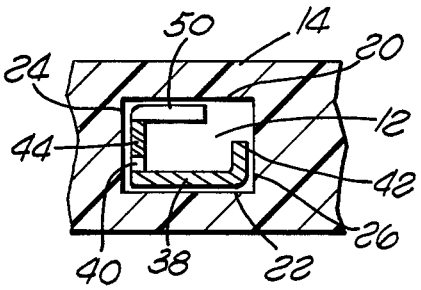
FIG. 4
FIG. 5

CONTACT RETENTION ASSEMBLY

BACKGROUND OF THE INVENTION

The present invention relates generally to an electrical connector and, more particularly, to a contact retention assembly for an electrical connector and a new contact for use in such an assembly.

It is well known in the art to utilize spring retention tines to releasably retain electrical contacts in insulators of electrical connectors. Typically, a resilient spring tine is stamped from the wall of the contact and bent outwardly and rearwardly of the contact so that the tine will deflect inwardly when the contact is inserted into a contact cavity in an insulator from the rear of the insulator. After the tine passes a rearwardly facing shoulder on the wall of the cavity, the tine springs outwardly to engage the shoulder and thereby restrict rearward movement of the contact in the cavity.

On some occasions, it is necessary to provide a contact of either U-shaped or box-shaped cross-section, such as when it is desired to provide two overlapping slotted arms for an insulation displacement contact construction. If the retention tine were stamped from the wall of such a contact and bent outwardly to engage a shoulder in the contact cavity of an insulator, it will be appreciated that the transverse extent of the contact will be increased, thereby requiring larger cross-section contact cavities which results in a decrease in the density of contacts in the connector. The purpose of the present invention is to provide a contact retention assembly which may be used in a contact having either a U-shaped or box-shaped body without the spring retention tine thereof extending outwardly, whereby the cross-section of the contact may be minimized.

U.S. Pat. No. 4,006,961, to Langenbach discloses a contact retention assembly in which a hollow cylindrical contact embodies a contact retention tine which is stamped out of one sidewall of the contact and extends through an opening in the opposite sidewall to dig into the wall of the cavity to prevent rearward movement of the contact in the cavity. A special tool is required to be threaded through an aperture in the contact in front of the tine in order to deflect the tine rearwardly thereby releasing it from engagement from the wall of the contact cavity. The tine does not engage a shoulder in the contact cavity to provide positive retention of the contact which is preferred for many connector applications. The present invention utilizes a shoulder in the contact cavity for engagement with the spring tine to assure positive locking of the contact in the cavity, and avoids the requirement for a special threaded tool as in the Langenbach patent.

SUMMARY OF THE INVENTION

According to a principal aspect of the present invention, there is provided an electrical contact which is adapted to be mounted in a contact cavity in an insulator of an electrical connector. The contact comprises an electrically conductive body having a forward section and a retention section behind the forward section. The retention section has a generally flat, elongated base with a pair of side edges and an upstanding sidewall along one of said edges. A spring retention tine formed from the sidewall extends rearwardly and inwardly toward the other of the edges whereby the end of the tine may engage a forwardly facing shoulder in the contact cavity adjacent to the other edge.

According to another aspect of the present invention, there is provided an electrical connector comprising an insulator having a contact cavity therein. The cavity has a top, bottom, and a pair of sides. A projection extends inwardly into the cavity from the top toward but short of the bottom providing a space therebetween. The projection is also spaced from one of the sides of the cavity and provides a forwardly facing shoulder. An electrical contact is mounted in the cavity. The contact comprises an electrically conductive body having a forward section and a retention section behind the forward section. The retention section has a generally flat elongated base lying on the bottom of the cavity and an upstanding sidewall adjacent to one side of the cavity. A spring retention tine formed from the sidewall extends rearwardly and inwardly toward the other side of the cavity with the end of the tine engaging the shoulder in the cavity to restrict rearward movement of the contact in the cavity.

BRIEF DESCRIPTION OF THE DRAWINGS

FIG. 3 is a transverse sectional view taken along line 3—3 of FIG. 1;

FIG. 4 is a transverse sectional view taken along line 4—4 of FIG. 1; and, FIG. 5 is a fragmentary, partial sectional view similar to FIG. 1 but showing the contact only partially inserted into the insulator.

DESCRIPTION OF THE PREFERRED EMBODIMENT

Figure 1:
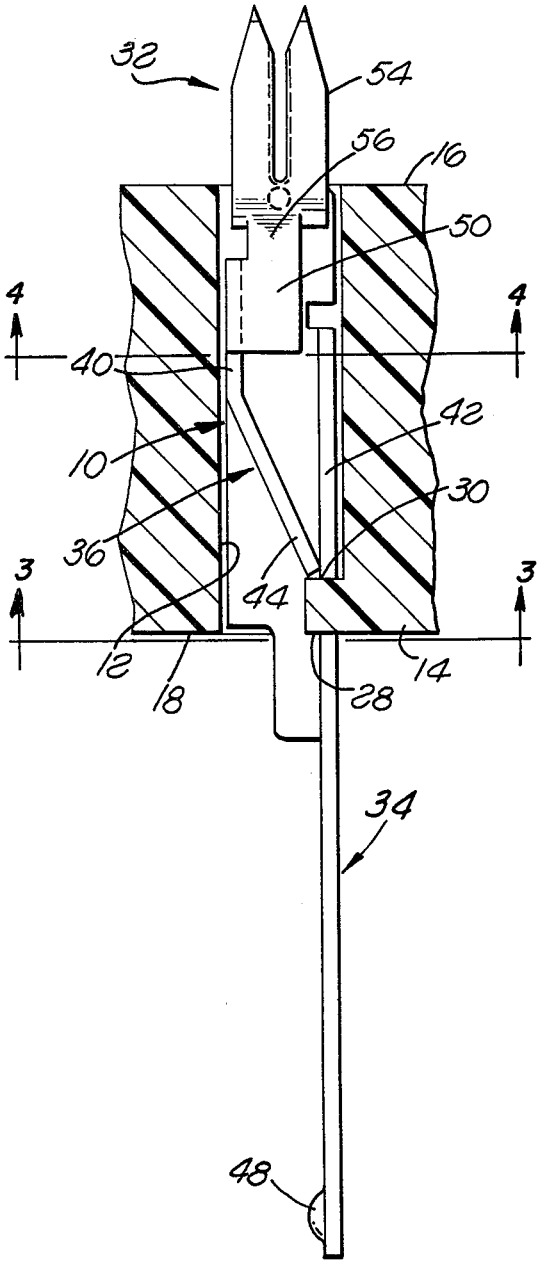
FIG. 1 is a fragmentary, partial sectional view taken along line 1—1 of FIG. 3, showing a contact mounted in an insulator in accordance with the present invention.
Figure 2:
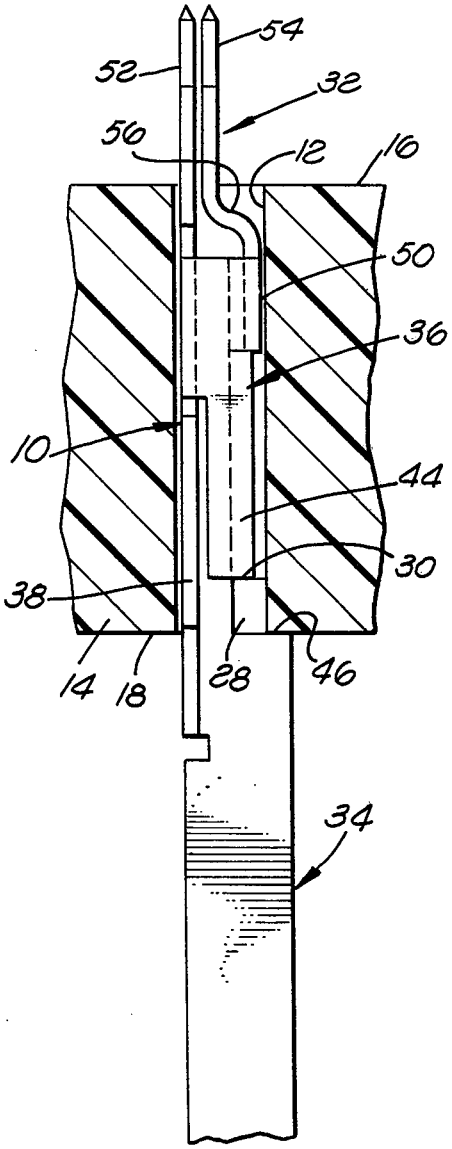
FIG. 2 is a fragmentary, partial sectional view taken along line 2—2 of FIG. 3.

Referring now to the drawings in detail, there is illustrated the contact of the present invention, generally designated 10, mounted in a cavity 12 in an electrical connector insulator 14. The contact cavity extends from the front face 16 to the rear face 18 of the insulator. As best seen in FIG. 4, the contact cavity has a rectangular cross-section, providing a top 20, a bottom 22, and a pair of parallel sides 24 and 26.

As best seen in FIG. 3, a projection 28 is provided in a corner of the cavity 12 adjacent to the rear face 18 of the insulator. The projection is integral with the top 20 and side 26 of the cavity and is spaced from the side 24 and bottom 22. The projection provides a forwardly facing shoulder 30.

The contact 10 comprises an electrically conductive body having a forward termination section 32, a rear contacting section 34, and an intermediate contact retention section 36.

A portion of the intermediate retention section 36 of the contact has a U-shaped cross-section, providing an elongated flat base 38 and a pair of upstanding sidewalls 40 and 42 along the edges thereof. A spring retention tine 44 is formed from the sidewall 40. The tine extends rearwardly and inwardly toward the opposite sidewall 42, and is preferably biased against the sidewall. With the contact fully seated in the insulator 14, the end of the tine 44 engages the shoulder 30 formed by projection 28 to restrict rearward movement of the contact in the insulator.

The rear contacting section 34 of the contact comprises a rear extension of the sidewall 42 of the retention section 36 of the contact. In the embodiment of the invention illustrated in the drawings, the rear contacting section 34 has a width greater than the height of the contact cavity 12 thereby providing a forwardly facing shoulder 46 which engages the rear face 18 of the insulator to restrict forward movement of the contact in the insulator once the spring tine 44 snaps in front of the shoulder 30 in the contact cavity. A rounded contacting button 48 is formed on the lower end of the contacting section 34 of the contact. Obviously, the contacting section of the contact may have any desired configuration.

The contact retention section 36 of the contact also includes an upper wall 50 which extends from the top of the sidewall 40 toward but short of the sidewall 42. The width of the upper wall 50 is less than the distance between the side 24 of the cavity and the projection 28 so that the upper wall may pass by the projection when the contact is inserted into the cavity 12 from the rear of the insulator. As seen in FIG. 3, the sidewall 42 has a height less than the distance between the projection 28 and the bottom 22 of the cavity to permit the sidewall 42 to pass under the projection when the contact is inserted into the cavity.

The forward termination section 32 of the contact, is the preferred embodiment of the invention illustrated in the drawings, comprises a pair of longitudinally slotted arms 52 and 54, which are positioned in close parallel overlapping relationship. The arms are adapted to receive therein a wire (not shown) for insulation displacement termination to the contact 10. The arm 52 comprises a forward extension of the flat base 38 of the contact. The arm 54 is a forward extension of the upper wall 50, which is offset at 56 to bring the arm in close proximity with the arm 52. As seen in FIG. 1, the slots in the arms are aligned with each other. The arms have a width slightly less than the width of the contact cavity 12. However, because the arms are located adjacent to the bottom 22 of the cavity, and have a thickness less than the space between the projection 28 and the bottom of the cavity, the arms may slide under the projection 28 when the contact is inserted into the cavity.

As best seen in FIG. 5, when the contact is initially inserted into the cavity 12, the spring retention tine 44 rides over the projection 28 until the end of the tine passes the shoulder 30 whereupon the tine will spring outwardly to the position illustrated in FIG. 1 wherein the tine will cooperate with the shoulder to lock the contact in the insulator.

The tine may be released from the shoulder 30 for removal of the contact from the insulator by simply inserting a common flat tool (not shown) into cavity 12 from the front of the insulator between the sidewall 42 of the contact and the upper wall 50.

Because the spring retention tine in the contact of the present invention extends inwardly rather than outwardly as in conventional contacts of this type, the cross-section of the contact is maintained to a minimum, thus leading to high density mounting of contacts in a connector insulator. Also, the contact retention assembly of the present invention provides positive locking of the contact in the insulator.

What is claimed is:

1. An electrical contact adapted to be mounted in a contact cavity in an insulator of an electrical connector comprising:

an electrically conductive body having a forward section and a generally U-shaped retention section behind said forward section;

said retention section having a generally flat, elongted base with a pair of upstanding sidewalls along the edges thereof;

a spring retention tine formed from one of said sidewalls extending rearwardly and inwardly toward the other of said sidewalls whereby the end of said tine may engage a forwardly facing corner shoulder in said contact cavity adjacent to said other sidewall; and said other sidewall blocking said tine from extending outwardly beyond the perimeter of said U-shaped retention section, thereby protecting said tine from damage during handling of the contact.

2. An electrical contact as set forth in claim 1 wherein:

said retention tine extends upwardly from said base a distance greater than said other sidewall so that said rear of said tine may engage said corner shoulder while said other sidewall may pass under the shoulder.

3. An electrical contact as set forth in claim 2 wherein:

said retention tine is biased against said other sidewall.

4. An electrical contact as set forth in claim 1 wherein:

said forward section of said body comprises a forward extension of said flat base.

5. An electrical contact as set forth in claim 4 wherein:

said extension embodies a forwardly opening slot adapted to receive a wire therein.

6. An electrical contact as set forth in claim 2 wherein:

said other sidewall embodies a rearwardly extending portion providing a rear contacting section of said body.

7. An electrical contact adapted to be mounted in a contact cavity in an insulator of an electrical connector comprising:

an electrically conductive body having a forward section and a retention section behind said forward section;

said retention section having a generally flat, elongated base with a pair of side edges and an upstanding sidewall along one of said edges;

a spring retention tine formed from said sidewall extending rearwardly and inwardly toward the other of said edges whereby the end of said tine may engage a forwardly facing shoulder in said contact cavity adjacent to said other edge;

an upper wall extending transversely from the top of said sidewall toward but short of said other edge so as to be free to pass by said shoulder when said contact is inserted into the contact cavity; and said upper wall embodying a forward extension formed with a forwardly opening slot adapted to receive a wire therein, said extension forming a part of said forward section of said body.

8. An electrical contact as set forth in claim 7 wherein:

said forward section also includes a forward extension of said flat base having a wire receiving slot therein aligned with said slot in said upper wall extension.

9. An electrical contact as set forth in claim 8 wherein:

said upper wall forward extension is offset downwardly relative to said upper wall to a position in close parallel relationship with said flat base forward extension.

10. An electrical connector comprising:

an insulator having a front face and a rear face with a contact cavity therein extending from said front face to said rear face;

said cavity having a top, a bottom and a pair of sides;

a projection in one corner of said cavity joined to said top and one side thereof, said projection providing a forwardly facing shoulder;

an electrical contact mounted in said cavity, said contact comprising an electrically conductive body having a forward section and a generally U-shaped retention section behind said forward section;

said retention section having a generally flat elongated base lying on said bottom of said cavity and first and second upstanding sidewalls adjacent to said one side and the other side, respectively, of said cavity;

a spring retention tine formed from said second sidewall extending rearwardly and inwardly toward said one side with the end of said tine engaging said shoulder to restrict rearward movement of said contact in said cavity; and said first sidewall blocking said tine from extending outwardly beyond the perimeter of said U-shaped retention section and being sufficiently short so as to pass under said projection when said contact is inserted into said cavity from said rear face of said insulator.

11. An electrical connector as set forth in claim 10 wherein:

said first sidewall is located below said projection.

12. An electrical connector as set forth in claim 11 wherein:

said retention tine is biased against said first sidewall.

13. An electrical connector as set forth in claim 10 wherein:

said forward section of said body comprises an extension of said base; and said extension having a height less than the distance between said projection and said bottom whereby said extension is slidable under said projection upon insertion of said contact into said cavity from said rear face of said insulator.

14. An electrical connector as set forth in claim 13 wherein:

said extension extends forwardly of said front face of said insulator; and said extension embodies a forwardly opening slot adapted to receive a wire therein.

15. An electrical connector as set forth in claim 11 wherein:

said first sidewall embodies a rearwardly extending portion providing a rear contacting section of said body; and said rear contacting section extending rearwardly of said rear face of said insulator.

16. An electrical connector comprising:

an insulator having a front face and a rear face with a contact cavity therein extending from said front face to said rear face;

said cavity having a top, a bottom and a pair of sides;

a projection extending inwardly into said cavity from said top toward but short of said bottom providing a space therebetween, said projection being spaced from one of said sides of said cavity and providing a forwardly facing shoulder;

an electrical contact mounted in said cavity, said contact comprising an electrically conductive body having a forward section and a retention section behind said forward section;

said retention section having a generally flat elongated base lying on said bottom of said cavity and an upstanding sidewall adjacent to said one side of said cavity;

a spring retention tine formed from said sidewall extending rearwardly and inwardly toward the other of said sides with the end of said tine engaging said shoulder to restrict rearward movement of said contact in said cavity;

an upper wall extending transversely from the top of said sidewall toward said other side of said contact cavity a distance less than the distance between said one side and said projection whereby said upper wall is free to pass by said projection when said contact is inserted into said contact cavity; and said upper wall embodying a forward extension protruding forwardly of said front face and formed with a forwardly opening slot adapted to receive a wire therein, said extension forming a part of said forward section of said body.

17. An electrical connector as set forth in claim 16, wherein:

said forward section also includes a forward extension of said flat base having a wire receiving slot therein aligned with said slot in said upper wall extension.

18. An electrical connector as set forth in claim 17 wherein:

said upper wall forward extension is offset downwardly relative to said upper wall to a position in close parallel relationship with said flat base forward extension; and the thickness of said extensions being less than said space between said projection and said bottom of said contact cavity.

* * * * *